US009207575B2

(12) United States Patent
Tanaka

(10) Patent No.: US 9,207,575 B2
(45) Date of Patent: Dec. 8, 2015

(54) DEVELOPER CONTAINER, DEVELOPING DEVICE, DEVELOPING SUPPLY DEVICE, PROCESS CARTRIDGE AND IMAGE FORMING APPARATUS

(71) Applicant: CANON KABUSHIKI KAISHA, Tokyo (JP)

(72) Inventor: Hiroyuki Tanaka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/284,433

(22) Filed: May 22, 2014

(65) Prior Publication Data

US 2014/0348547 A1 Nov. 27, 2014

(30) Foreign Application Priority Data

May 27, 2013 (JP) ..... 2013-110872

(51) Int. Cl.
*G03G 15/08* (2006.01)
*G03G 21/18* (2006.01)
*G03G 21/16* (2006.01)

(52) U.S. Cl.
CPC ..... *G03G 15/0886* (2013.01); *G03G 21/1676* (2013.01)

(58) Field of Classification Search
CPC ..... G03G 15/0886; G03G 21/1676; G03G 21/18; G03G 2215/0692
USPC ..... 399/258, 260, 262, 119, 120
See application file for complete search history.

(56) References Cited

U.S. PATENT DOCUMENTS

2007/0237551 A1* 10/2007 Kawai ..... 399/258
2008/0181673 A1* 7/2008 Kim et al. ..... 399/258
2011/0052266 A1* 3/2011 Yoon et al. ..... 399/258
2012/0114388 A1* 5/2012 Okoshi et al. ..... 399/262

FOREIGN PATENT DOCUMENTS

JP 2000-221766 A 8/2000

OTHER PUBLICATIONS

Co-pending U.S. Appl. No. 14/311,779, filed Jun. 23, 2014.

* cited by examiner

*Primary Examiner* — Sophia S Chen
(74) *Attorney, Agent, or Firm* — Fitzpatrick, Cella, Harper & Scinto

(57) ABSTRACT

A developer container includes: an accommodating frame, provided with an opening through which a developer is passable, for accommodating the developer; a first shutter and a second shutter which are movable between an open position where the opening opens and a closed position where the opening is closed; a first lever, provided on the first shutter, for moving the first shutter by being urged and moved; and a second lever, provided on the second shutter, for moving the second shutter by being urged and moved. Each of the first shutter and the second shutter is moved from the closed position to the open position by moving the first shutter and the second shutter in mutually spacing direction to open the opening.

14 Claims, 13 Drawing Sheets

(a)

(b)

(a)

(b)

(a)

(b)

(a)

(b)

(a)

(b)

(a)

(b)

(a)

(b)

(a)

(b)

DEVELOPER CONTAINER, DEVELOPING DEVICE, DEVELOPING SUPPLY DEVICE, PROCESS CARTRIDGE AND IMAGE FORMING APPARATUS

FIELD OF THE INVENTION AND RELATED ART

The present invention relates to a developer container, a developing device, a developer supply device, a process cartridge and an image forming apparatus.

In the image forming apparatus of an electrophotographic type, a photosensitive member electrically charged uniformly by a charging device is subjected to selective exposure by an exposure device to form an electrostatic latent image thereon. Then, the electrostatic latent image is developed by supplying a developer thereto by the developing device, so that a toner image as a developer image is formed. Thereafter, there is a need to supply the developer from the developer supply device every use-up of the developer.

In a conventional constitution, there are the developing device constituted integrally with the developer supply device and the developing device constituted as a separate member from the developer supply device. In the separate constitution, the developing device and the developer supply device are separable from each other. A transfer of the developer is made at connecting portions of the developing device and the developer supply device. Each of the connecting portions is provided with an opening through which the developer is possible.

Here, the developing device and the developer supply device are detachably mountable to an image forming apparatus main assembly and are provided with shutters for blocking openings through which the developer is leaked out and scattered or is dropped down in a state in which the devices are demounted from the apparatus main assembly.

However, even when the shutters are provided, there is a fear that the developer is leaked out from a gap between the shutter and the opening. In order to reduce a degree of the leakage, Japanese Laid-Open Patent Application (JP-A) 2000-221766 discloses a toner cartridge 41 having a double-shutter structure in which two shutters 42*a* and 44 are provided at a single opening 48 (FIG. 12). FIG. 12 is a schematic view showing a state in which the shutters block the opening, and FIG. 13 is a schematic view showing a state in which the shutters open (expose) the opening.

First, the toner cartridge 41 is moved in an arrow HH direction of FIG. 13, and is mounted on a feeding device 46. At this time, a lever 42*b* provided integrally with the (one) shutter 42*a* for blocking the opening 48 of the toner cartridge 41 is pressed in an arrow JJ direction by a projection 45 provided on the feeding device 46, so that the shutter 42*a* is moved in the arrow JJ direction.

In interrelation with the movement of the shutter 42*a*, the other shutter 44 is rotated about a rotation center 47 in an arrow KK direction, so that the two shutters 42*a* and 44 are deviated from the opening 48. For that reason, in a state in which the toner cartridge 41 is mounted on the feeding device 46, a toner accommodated in the toner cartridge 41 can be fed in an arrow II direction and thus can be delivered to the feeding device 46.

Here, in the double shutter structure disclosed in JP-A 2000-221766, in a state in which the developer supply device and the developing device are demounted from the image forming apparatus, in the case where a user accesses the developer supply device and the developing device, there was a fear that the user can accidentally open the two shutters easily depending on an access position. This is because in the double shutter structure disclosed in JP-A 2000-221766, the two shutters are opened under application of a force in one direction.

Further, even when directions of forces necessary to be applied to the two shutters in order to open and close the two shutters are different from each other, in the case where a constitution in which the user can easily hold or grip the lever is employed, the two shutters are to be easily opened.

In this way, even when the double shutter structure is employed in order to prevent the leakage of the developer, in the case where the user accesses the shutter in the state in which the developer supply device and the developing device are demounted from the apparatus main assembly, there was a problem that the shutter was easily opened and closed and thus the developer leaks out through the opening to contaminate a periphery of the opening.

SUMMARY OF THE INVENTION

In view of the above problem, a principal object of the present invention is to provide a developer container having a shutter constitution capable of suppressing leakage of a developer.

According to an aspect of the present invention, there is provided a developer container comprising: an accommodating frame, provided with an opening through which a developer is passable, for accommodating the developer; a first shutter and a second shutter which are movable between an open position where the opening opens and a closed position where the opening is closed; a first lever, provided on the first shutter, for moving the first shutter by being urged and moved; and a second lever, provided on the second shutter, for moving the second shutter by being urged and moved, wherein each of the first shutter and the second shutter is moved from the closed position to the open position by moving the first shutter and the second shutter in mutually spacing direction to open the opening.

According to another aspect of the present invention, there is provided a developer container comprising: an accommodating frame, provided with an opening through which a developer is passable, for accommodating the developer; a first shutter and a second shutter which are movable between an open position where the opening opens and a closed position where the opening is closed; a first lever, provided on the first shutter, for moving the first shutter by being urged and moved; and a second lever, provided on the second shutter, for moving the second shutter by being urged and moved, wherein each of the first shutter and the second shutter is moved from the closed position to the open position by moving the first shutter and the second shutter in mutually approaching direction and then in mutually spacing direction to open the opening.

According to another aspect of the present invention, there is provided a developing device detachably mountable to a main assembly of an image forming apparatus, comprising: the above-described developer container to which the developer is to be supplied from a developer supply device, wherein in a process of mounting the developing device into the main assembly of the image forming apparatus, the first shutter is moved from the closed position to the open position by urging the first lever by an urging portion provided on the developer supply device.

According to another aspect of the present invention, there is provided a developer supply device, detachably mountable to a main assembly of an image forming apparatus, for supplying a developer to a developing device, comprising: the above-described developer container for accommodating the developer, wherein in a process of mounting the developer supply device into the main assembly of the image forming apparatus, the first shutter is moved from the closed position to the open position by urging the first lever by an urging portion provided on the developing device.

According to another aspect of the present invention, there is provided a process cartridge, detachably mountable to a main assembly of an image forming apparatus, including a process means for performing an image forming process, comprising: an first bearing member for bearing a latent image; and the above-described developing device.

According to a further aspect of the present invention, there is provided an image forming apparatus for forming an image on a recording material with a developer, comprising: an image bearing member for bearing a latent image; the above-described developer container; and an openable door including an urging portion for urging the second shutter from the closed position to the open position by urging the second lever with a closing operation thereof.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments for carrying out the present invention will be specifically described with reference to the drawings. Dimensions, materials, shapes and relative arrangement of constituent elements described in the following embodiment should be appropriately be changed depending on structures and various conditions of devices (apparatuses) to which the present invention is applied. Accordingly, unless otherwise specified, the scope of the present invention is not intended to be limited thereto.

Embodiment 1

<General Structure>

Figure 2:
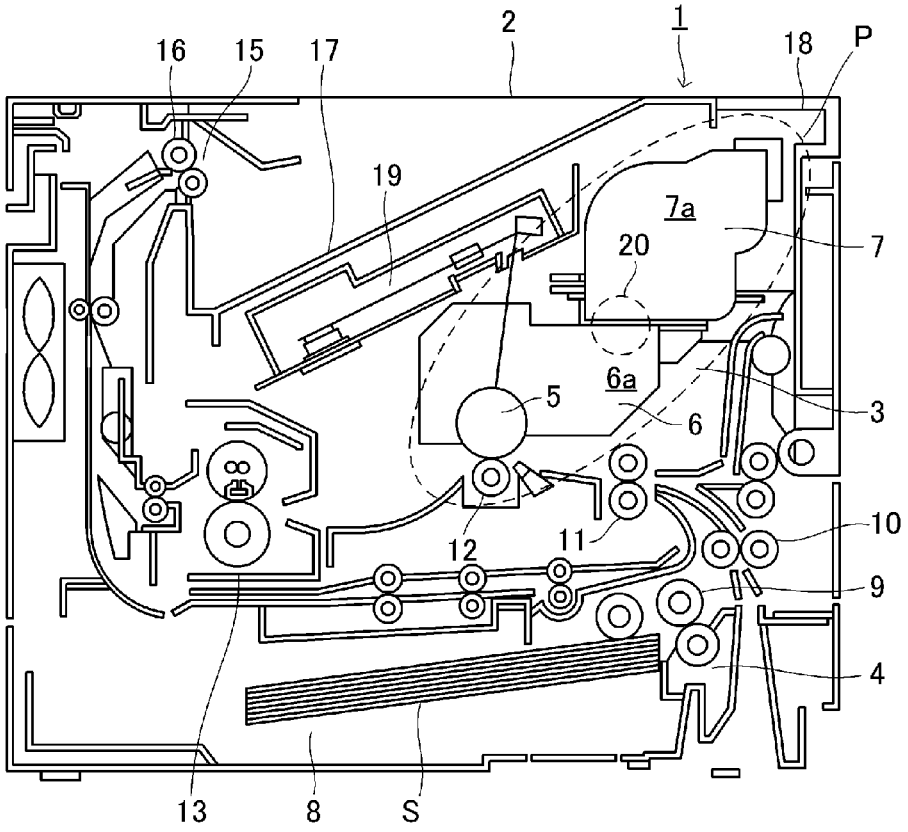
FIG. 2 is a schematic sectional view showing a structure of an image forming apparatus according to Embodiment 1.

First, with reference to FIG. 2, a general structure of an image forming apparatus according to Embodiment 1 of the present invention will be described. FIG. 2 is a schematic sectional view showing a structure of the image forming apparatus in this embodiment. Incidentally, in this embodiment, as the image forming apparatus, a laser beam printer is described, but the image forming apparatus is not limited thereto. As the image forming apparatus, it is also possible to use an electrophotographic copying machine, an LED printer, an electrophotographic facsimile apparatus, an electrophotographic word processor, and the like.

As shown in FIG. 2, an image forming apparatus 1 includes an image forming portion 3, a paper(sheet)-feeding device 4, a transfer roller 12, a fixing device 13, a paper-discharging device 15 and a laser scanner 19. The paper-feeding device 4 includes a paper-feeding cassette 8 provided detachably mountable to an image forming apparatus main assembly 2 and a paper-feeding roller 9, provided over the paper-feeding cassette 8, for feeding a sheet S accommodated in the paper-feeding cassette 8. The fixing device 13 fixes an image, formed at the image forming portion 3, on the sheet S. The paper-discharging device 15 discharges the sheet S, on which the image is fixed, onto a paper discharge tray 17.

Further, the image forming portion 3 includes a photosensitive drum 5 as an image bearing member, a developing device 6, and a developer supply device for supplying a developer to the developing device 6 via a connecting portion 20. Incidentally, the connecting portion 20 is provided with openings 31 and 51 described later. The photosensitive drum 5 is provided in a developing device frame constituting the developing device 6, and the developing device 6 is constituted so as to be detachably mountable to the apparatus main assembly 2. Also the developer supply device 7 is constituted so as to be detachably mountable to the apparatus main assembly 2. Further, the developing device 6 and the developer supply device 7 are constituted so as to be detachably mountable to each other, and constitute a process cartridge P detachably mountable to the apparatus main assembly 2. The process cartridge P includes the photosensitive drum 5 and various process means, actable on the photosensitive drum 5, for performing an image forming process. Further, the apparatus main assembly 2 is provided with an openable door 18, and in an open state of the openable door 18, the process cartridge P is insertable into the apparatus main assembly 2. Incidentally, FIG. 2 shows a mounted state of the process cartridge P (including the developing device 6 and the developer supply device 7) in the apparatus main assembly 2 and shows a closed state of the openable door 18.

Here, a brief description of an image forming operation in the image forming apparatus 1 in this embodiment will be made. First, the photosensitive drum 5 is exposed to light by the laser scanner 19, so that a latent image is formed on the photosensitive drum 5. Thereafter, the latent image is developed by supplying a toner as a developer from the developing device 6, so that a toner image as a developer image is formed on a surface of the photosensitive drum 5.

On the other hand, the sheet-feeding device feeds the sheet S, as a recording material accommodated in the paper-feeding cassette 8, by the paper-feeding roller 9 and thereafter conveys the sheet S to a registration roller pair 11 by a conveying roller pair 10 in parallel to the image forming operation at the image forming portion 3. Incidentally, after being conveyed to the registration roller pair 11 as described above, the sheet S is conveyed at predetermined timing to a transfer portion formed by the photosensitive drum 5 and the transfer roller 12.

Onto the sheet S conveyed to the transfer portion, the toner image formed on the surface of the photosensitive drum 5 is transferred at the transfer portion. Thereafter, the sheet S is conveyed into the fixing device 13, and is heated and pressed in the fixing device 13, so that the toner image is fixed on the sheet S. Then, the sheet S is, after the toner image is fixed thereon, discharged onto the paper discharge tray 17, provided at an upper surface of the apparatus main assembly 2, via a paper-discharging path by a paper-discharging roller pair 16 provided in the paper-discharging device 15. In this way, a series of an image forming operation is completed.

<Shutter Structure of Developer Supply Device>

Figure 1:
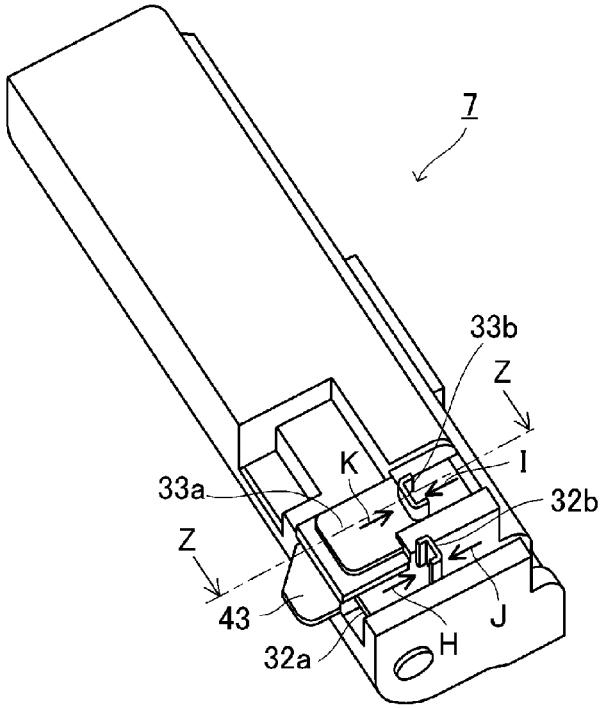
In FIG. 1, (a) and (b) are schematic views each showing a closed state of a shutter of a developer supply device according to Embodiment 1.
Figure 1:
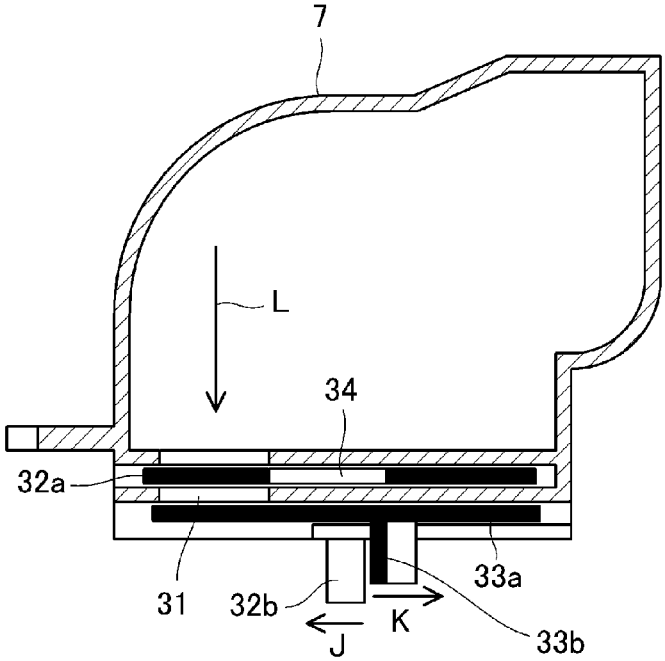
Figure 3:
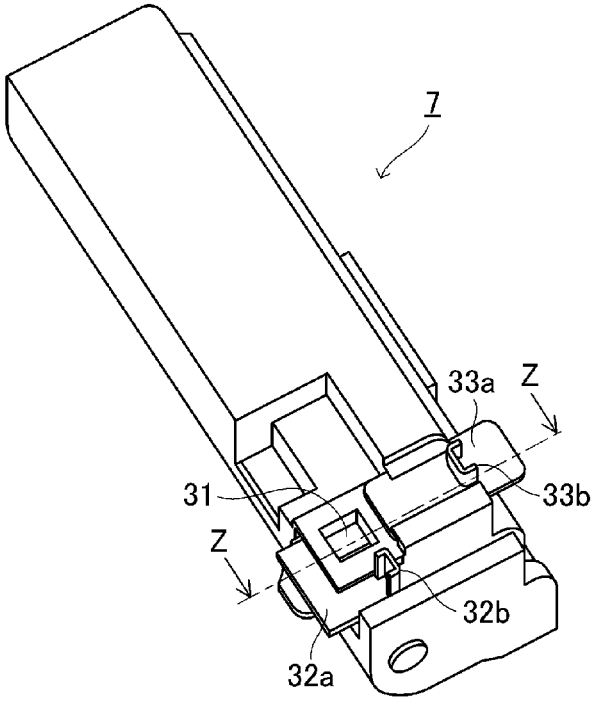
In FIG. 3, (a) and (b) are schematic views each showing an open state of the shutter of the developer supply device according to Embodiment 1.
Figure 3:
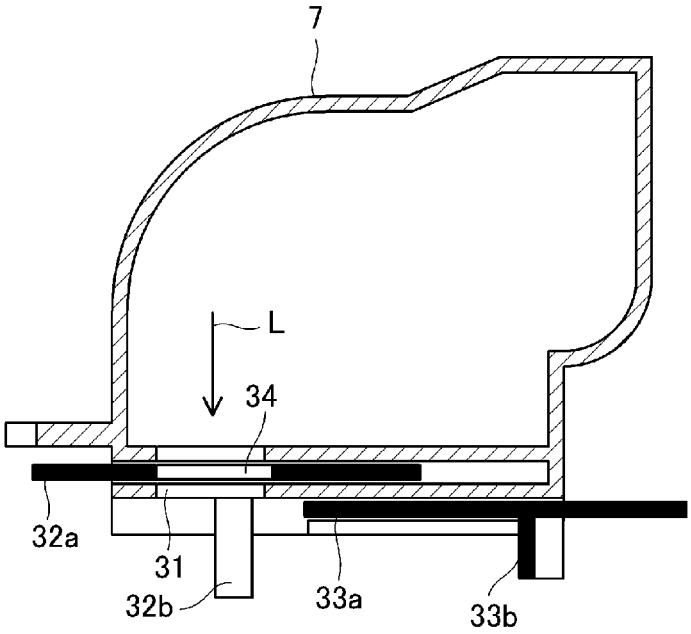

Next, with reference to FIGS. 1 and 3, a shutter structure of the developer supply device according to Embodiment 1 will be described. In FIG. 1, (a) and (b) are schematic views each showing the shutter structure of the developer supply device in this embodiment and showing a closed state of shutters, in which (a) is a schematic perspective view of the developer supply device as seen from an obliquely lower direction, and (b) is Z-Z cross-sectional view of (a). In FIG. 3, (a) and (b) are schematic views each showing the shutter structure of the developer supply device in this embodiment and showing an open state of the shutters, in which (a) is a schematic perspective view of the developer supply device as seen from the obliquely lower direction, and (b) is Z-Z cross-sectional view of (a).

As shown in (b) of FIG. 1 and FIG. 2, the developer supply device 7 in this embodiment includes a developer container 7*a*. The developer container 7*a* accommodates the developer and includes an accommodating frame provided with the opening 31 through which the developer is passable. Through the opening 31, the developer accommodated in the developer container can be supplied to a developer container 6*a* of the developing device 6. Further, as a plurality of shutters provided so as to be capable of opening (exposing) the opening 31, a first shutter 32*a* and a second shutter 33*a* are provided. Each of the first shutter 32*a* and the second shutter 33*a* is provided movably between an open position where the opening 31 is open (exposed) and a closed position where the opening 31 is closed. As shown in (b) of FIG. 1 and (b) of FIG. 3, the shutter 32*a* is provided with a hole 34, through which an inside and an outside of the developer container 7*a* are communicatable, by overlapping with the opening 31.

Further, the shutter 32*a* is constituted integrally with a first lever 32*b* for moving the shutter 32*a*, and the shutter 33*a* is contacted integrally with a second lever 33*b* for moving the shutter 33*a*. In this way, in this embodiment, by providing the two shutters 32*a* and 33*a*, leakage of the developer, accommodated in the developer container 7*a*, through the opening 31 is suppressed, e.g., in the case where the developer supply device 7 is demounted from the apparatus main assembly 2 and then is carried.

Here, the shutter 32*a* is urged in an arrow H direction in (a) of FIG. 1 by an unshown spring, and is held at a blocking position of the opening 31. Further, the shutter 33*a* is urged in an arrow I direction in (a) of FIG. 1 by an unshown spring, and is held at a blocking position of the opening 31. In this way, the opening 31 is blocked by the shutters 32*a* and 33*a*, whereby the developer accommodated in the developer container 7*a* of the developer supply device 7 is placed in a state in which the developer is not fed into the developer container 6*a* of the developing device 6, i.e., in an arrow L direction in (b) of FIG. 1.

Here, when an operation for moving the lever 32*b* in an arrow J direction in (b) of FIG. 1 is performed, the shutter 32*a* is moved in the arrow J direction, so that as shown in (b) of FIG. 3, the hole 34 of the shutter 32*a* is located at an overlapping position with the opening 31. On the other hand, when an operation for moving the lever 33*b* in an arrow K direction in (b) of FIG. 1 is performed, the shutter 33*a* is moved in the arrow K direction, so that as shown in (b) of FIG. 3, the shutter 33*a* is located at a position where the shutter 33*a* opens (exposes) the opening 31. Here, as shown in (a) and (b) of FIG. 1, the arrow K and J directions are opposite directions in which the levers 32*b* and 33*b* are spaced from each other.

In this way, by operating the levers 32*b* and 33*b*, the shutters 32*a* and 33*a* are moved, so that as shown in (a) and (b) of FIG. 3, the opening 31 is opened (exposed). As a result, the developer accommodated in the developer container 7*a* of the developer supply device 7 is feedable into the developer container 6*a* of the developing device 6, i.e., in an arrow L direction in (b) of FIG. 3.

In this way, in this embodiment, by moving the levers 32*b* and 33*b* in the opposite directions and in mutually spacing directions, so that the shutters 32*a* and 33*a* open (expose) the opening 31. For this reason, when a user accesses a shutter mechanism in a stand-alone state of the developer supply device 7 from the apparatus main assembly 2, it is possible to remarkably reduce a degree of a fear that the developer leaks out through the opening 31 of the developer supply device 7. This is because, in the shutter structure in this embodiment, even when the user touches the levers 32*b* and 33*b* by a holding or gripping operation, the open state of the opening 31 is not readily created by simultaneously moving the two shutters 32*a* and 33*a*.

<Shutter Structure of Developing Device>

Figure 4:
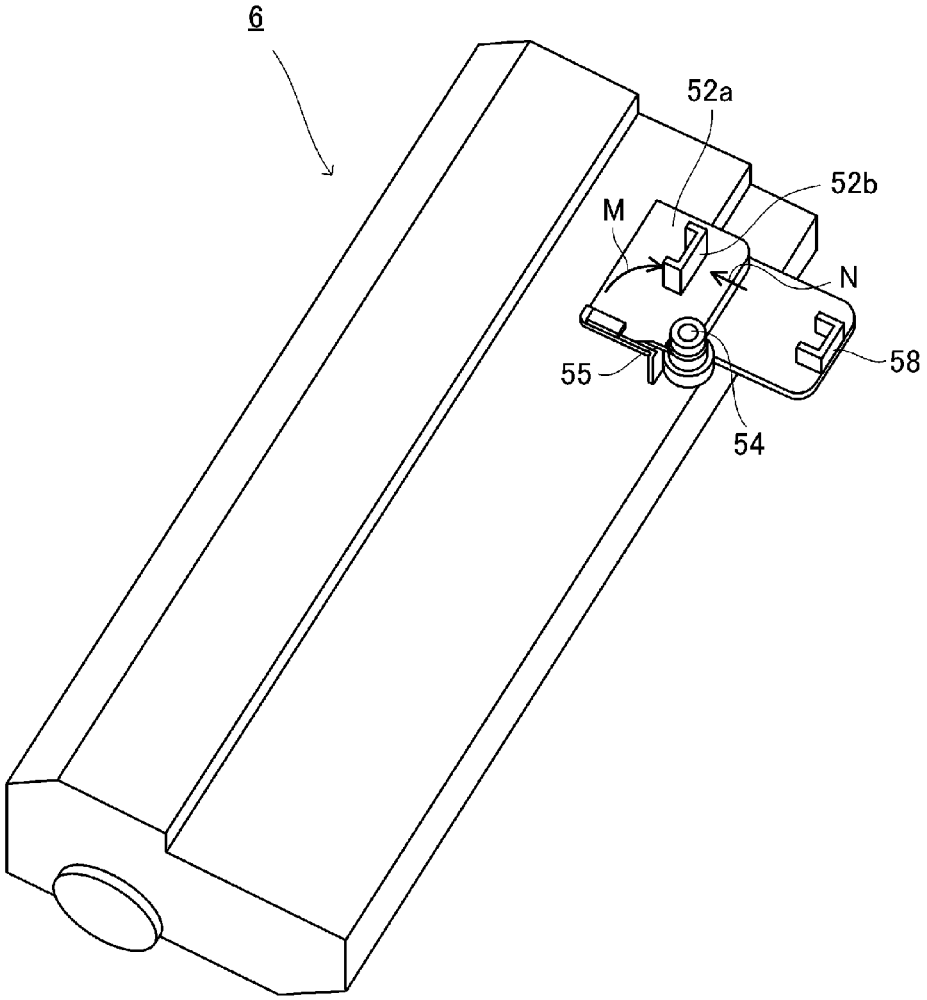
FIG. 4 is a schematic perspective view showing a closed state of a developing device according to Embodiment 1.
Figure 5:
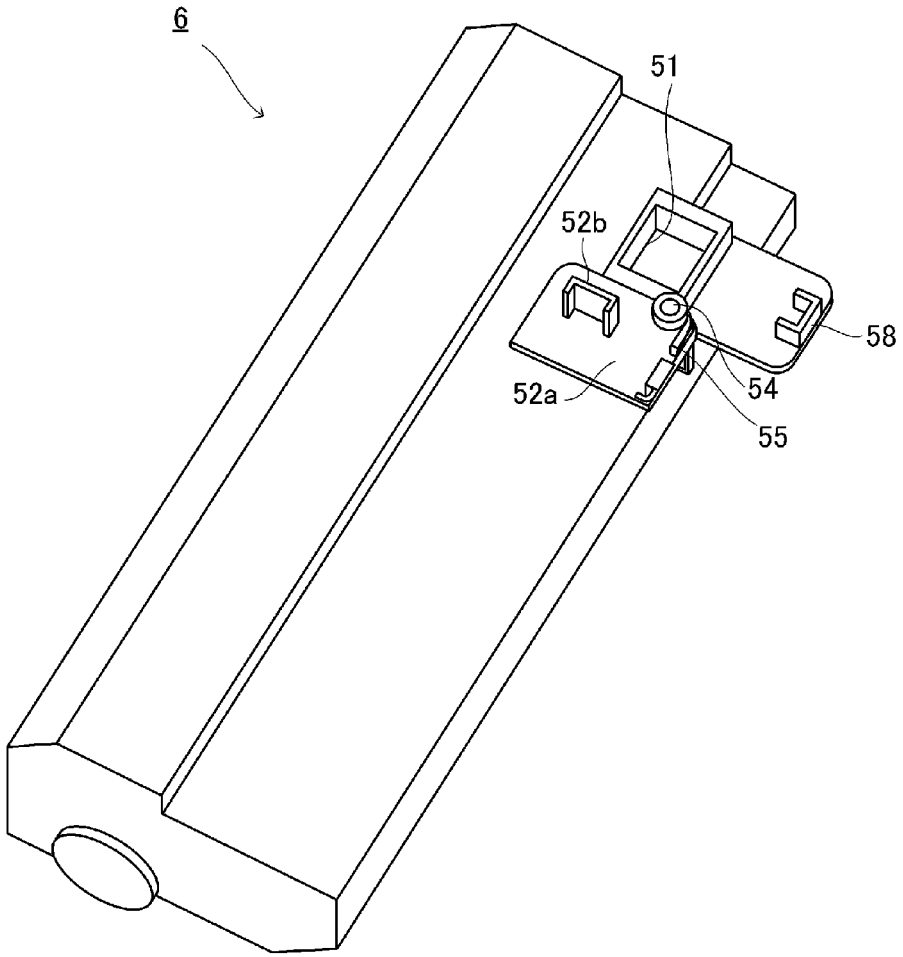
FIG. 5 is a schematic perspective view showing an open state of the developing device according to Embodiment 1.

Next, the developing device 6 in this embodiment will be described with reference to FIGS. 4 and 5. FIG. 4 is a schematic perspective view showing the developing device in this embodiment, and shows the closed state of the shutter. FIG. 5 is a schematic perspective view showing the developing device in this embodiment, and shows the open state of the shutter.

As shown in FIG. 5, the developing device 6 in this embodiment is provided with an opening 51 through which the developer is feedable from the developer supply device 7 into the developing device 6. Further, as shown in FIGS. 4 and 5, the developing device 6 is provided with a shutter 52*a* movable so as to be capable of opening (exposing) and closing (covering) the opening 51. The shutter 52*a* is provided integrally with a lever 52*b*, and is urged by a spring 55 in an arrow M direction in FIG. 4, i.e., in a blocking direction of the opening 51. Here, when the lever 52*b* is operated in an arrow N direction in FIG. 4 against an urging force of the spring 55, the shutter 52*a* is rotationally operated about a rotation-supporting point 54 to open the opening 51, so that a state in which the developer is feedable through the opening 51 is created.

<Shutter Operation During Mounting Operation>

Next, with reference to FIGS. 6 to 9, a mounting operation of the developer supply device 7 and the developing device 6 into the apparatus main assembly 2 in this embodiment, and an opening and closing operation of the shutters performed in interrelation with the mounting operation will be described. Incidentally, for convenience, in FIGS. 6 to 9, the apparatus main assembly 2 of the image forming apparatus 1 is illustrated in a partly omitted manner.

Figure 6:
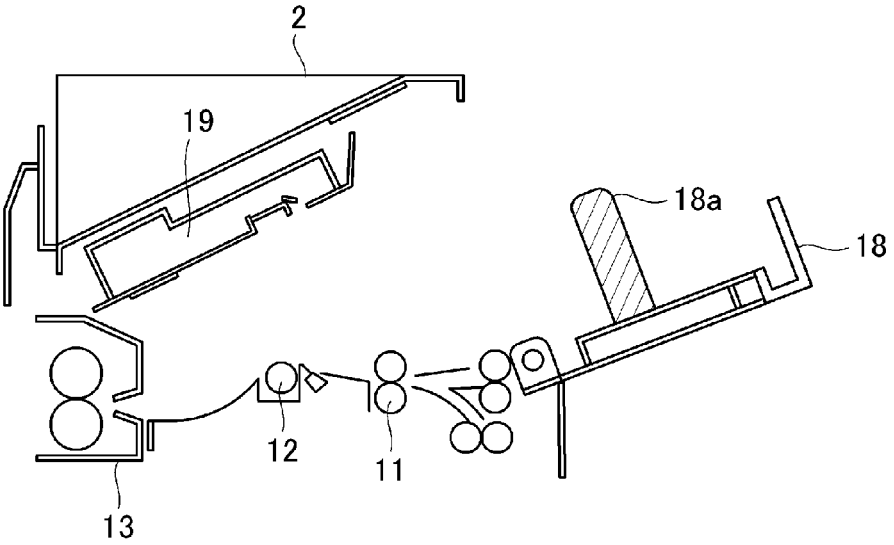
FIG. 6 is a schematic sectional view showing an unmounted state of the developing device and the developer supply device.
Figure 7:
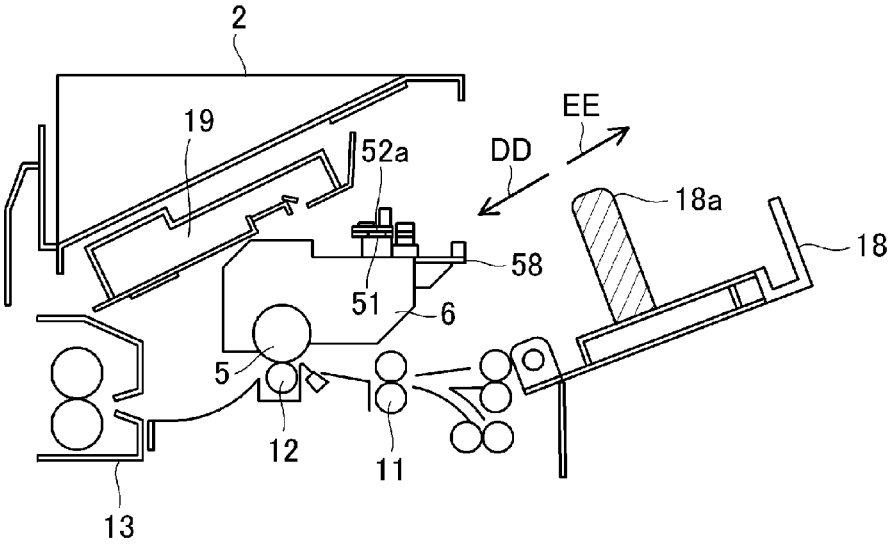
FIG. 7 is a schematic sectional view showing a mounted state of the developing device.

FIG. 6 is a schematic sectional view showing an unmounted state of the developing device and the developer supply device. FIG. 7 is a schematic sectional view showing a state in which the developing device is mounted. Further, FIGS. 6 and 7 show a state in which the openable door 18 of the apparatus main assembly 2 is open.

Figure 8:
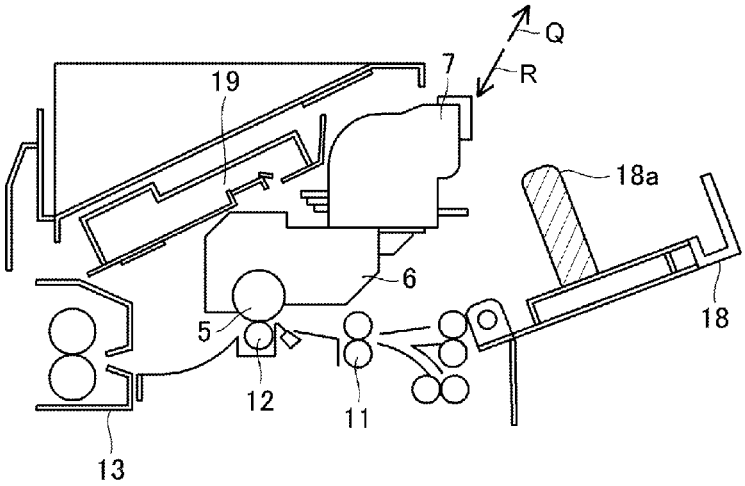
FIG. 8, (a) and (b) are schematic sectional views each showing a mounted state of the developing device and the developer supply device.
Figure 8:
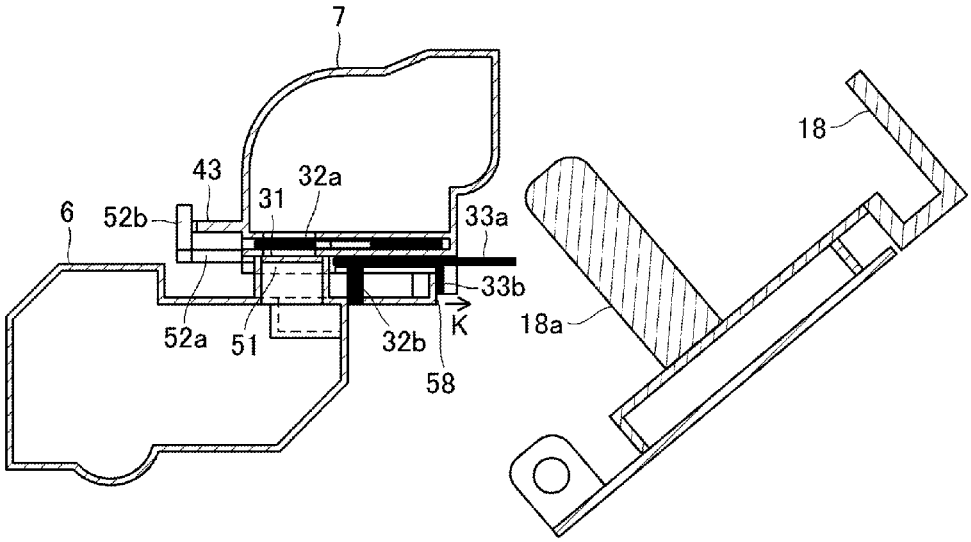
Figure 9:
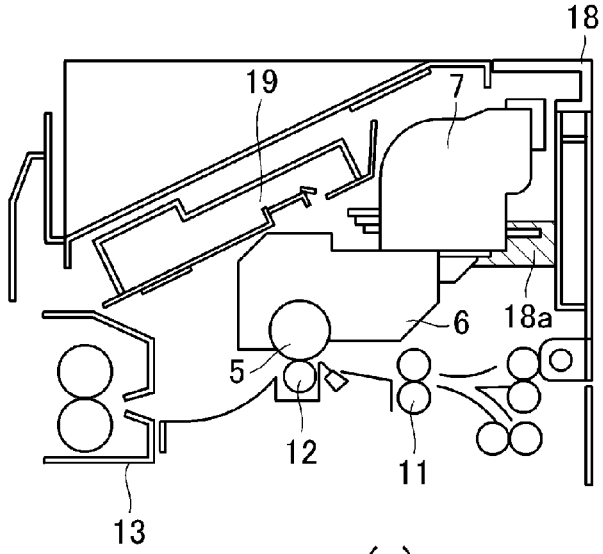
In FIG. 9, (a) and (b) are schematic sectional views each showing a closed state of an openable door in the mounted state.
Figure 9:
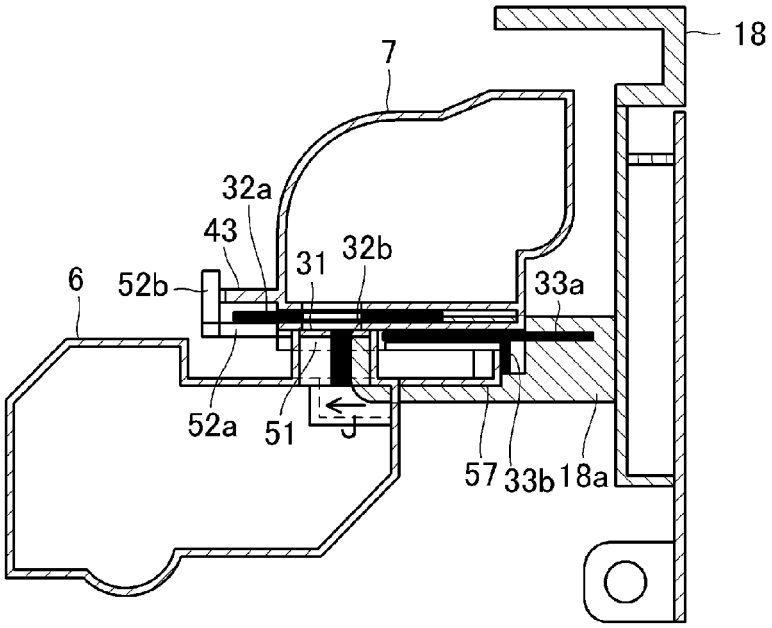

In FIG. 8, (a) and (b) are schematic sectional views each showing the mounted state of the developing device and the developer supply device into the apparatus main assembly and showing the open state of the openable door. In FIG. 8, (a) is the schematic view showing the state in which the developing device and the developer supply device are mounted in the apparatus main assembly, and (b) is an enlarged view in the neighborhood of an opening in (a) of FIG. 8. In FIG. 9, (a) and (b) are schematic sectional views each showing the mounted state of the developing device and the developer supply device into the apparatus main assembly and showing the closed state of the openable door. In FIG. 9, (a) is the schematic view showing the state in which the developing device and the developer supply device are mounted in the apparatus main assembly, and (b) is an enlarged view in the neighborhood of the opening in (a) of FIG. 8.

As shown in FIG. 6, the apparatus main assembly 2 of the image forming apparatus 1 in this embodiment is provided with the openable door 18 for being opened and closed for mounting the process cartridge P (including the developing device 6 and the developer supply device 7). As shown in FIG. 6, in the open state of the openable door 18, the process cartridge P can be inserted into the apparatus main assembly 2.

First, as shown in FIG. 7, into the apparatus main assembly 2, the developing device 6 is inserted in an arrow DD direction and then is moved to a mounted position. In this way, in a state before the mounting of the developing device 6 and in a state after the mounting of the developing device 6 and before the mounting of the developer supply device 7 into the apparatus main assembly 2, the shutter 52*a* of the developing device 6 blocks the opening 51. Accordingly, in the state shown in FIG. 7, unless the developer leaks out to the outside of the developing device 6, the developer is prevented from being fed into the developing device 6.

Thereafter, as shown in (a) of FIG. 8, the developer supply device 7 is inserted in an arrow R direction and then is moved to a mounted position. Here, the developing device 6 is provided with an abutment portion 58 as an urging portion as shown in FIGS. 4, 5 and 7 and (b) of FIG. 8. The abutment portion 58 is constituted so as to contact and urge the lever 33*b*, provided on the developer supply device 7, when the developer supply device 7 is inserted in the state in which the developing device 6 is located at the mounted position in the apparatus main assembly 2.

As shown in (a) and (b) of FIG. 8, when the developer supply device 7 is inserted in the arrow R direction, the lever 33*b* provided on the developer supply device 7 is pushed in an arrow K direction in (b) of FIG. 8 by the abutment portion 58. For that reason, the shutter 33*a* is moved to a position where the shutter 33*a* opens the opening 31.

In this state, i.e., in a state in which the developer supply device 7 is inserted to the mounted position and in which the openable door 18 is open, the shutter 32*a* of the developer supply device 7 is not moved but is located at the position where the shutter 32*b* blocks the opening 31. For that reason, although the shutter 33*a* is located in the position where the shutter 33*a* opens the opening 31, the developer is prevented from leaking out through the opening 31 of the developer supply device 7.

Here, as shown in (b) of FIG. 8, the developer supply device 7 is provided with a projection 43. The projection 43 is provided so that the projection 43 urges the lever 52*b*, provided on the developing device 6, when the developer supply device 7 is inserted into the apparatus main assembly 2. By urging the lever 52*b* by the projection 43, the shutter 52*a* is rotationally moved against the urging spring 55 and thus is moved to a position where the shutter 52*a* opens the opening 51 of the developing device 6 (FIG. 5).

Further, as shown in (a) of FIG. 9, the openable door 18 is closed in the state in which the developing device 6 and the developer supply device 7 are mounted in the apparatus main assembly 2. Here, the openable door 18 is provided with a projection 18*a* as a second urging portion. The projection 18*a* is constituted so as to urge the lever 32*b* of the developer supply device 7 in the arrow J direction in (b) of FIG. 9 by closing the openable door 18.

By urging the lever 32*b* by the projection 18*a*, the shutter 32*a* of the developer supply device 7 is moved in the arrow J direction, so that in a completely closed state of the openable door 18, the hole 34 of the shutter 32*a* is located at an overlapping position with the opening 31. On the other hand, as described above, the shutter 33*a* is in a deviated state from the opening 31 by pushing the lever 33*b* of the developer supply device 7 in the arrow K direction by the abutment portion 58 of the developing device 6. That is, the opening 31 of the developer supply device 7 is in the open state.

Further, as described above, the shutter 52*a* of the developing device 6 is in a deviated state from the opening 51 by urging the lever 53*b* by the projection 43 of the developer supply device 7. That is, the opening 51 of the developing device 6 is in the open state. Accordingly, in the state shown in (a) and (b) of FIG. 9, the developer accommodated in the developer container 7*a* of the developer supply device 7 is feedable into the developer container 6*a* of the developing device 6 via the openings 31 and 51.

As described above, in this embodiment, until the developing device 6 is inserted in the apparatus main assembly 2 and then the developer supply device 7 is mounted in the apparatus main assembly 2. The opening 51 of the developing device 6 is blocked by the shutter 52*a*. Further, in a state in which the developing device 6 is located at the mounted position and in which the developer supply device 7 is inserted halfway into the apparatus main assembly 2, the opening 31 of the developer supply device 7 is blocked by the shutters 32*a* and 33*a*. Further, in a state in which the developing device 6 is located at the mounted position and in which the developer supply device 7 is mounted in the apparatus main assembly 2, until the openable door 18 is closed, the opening 31 is blocked by the shutter 32*a*. In this way, a constitution in which in a process of mounting the developing device 6 and the developer supply device 7 into the apparatus main assembly 2, the developer accommodated in the developer containers 6*a* and 7*a* is not readily leaked out and scattered is employed.

<Shutter Operation During Demounting Operation>

Next, with reference to FIGS. 8 and 9, an operation of the shutters in the case where the developing device 6 and the developer supply device 7 are demounted from the apparatus main assembly 2 of the image forming apparatus 1 will be described.

First, the openable door 18 is opened from the state in which the developing device 6 and the developer supply device 7 are mounted as shown in (b) of FIG. 9, so that the openable door 18 is placed in the state of (a) and (b) of FIG. 8. In this state, the projection 18*a* of the openable door 18 is spaced from the lever 32*b* of the developer supply device 7. For that reason, the shutter 32*a* urged in the arrow H direction of (b) of FIG. 1 by an unshown spring is moved by an urging force of the spring to a position where the hole 34 does not overlap with the opening 31. For that reason, the shutter 32*a* is in the state in which the shutter 32*a* blocks the opening 31, and therefore the developer supply device 7 is placed in a state in which the developer is not leaked out from the developer supply device 7 and is not scattered.

Next, when the developer supply device 7 is started to be demounted from the apparatus main assembly 2 in the arrow Q direction, the projection 43 of the developer supply device 7 is separated from the lever 52*b* of the developing device 6 shown in (b) of FIG. 8. For that reason, the shutter 52*a* is moved to the position, by the urging force of the spring 55, where the shutter 52*a* blocks the opening 51 of the developing device 6. Thereafter, the developing device 6 is moved in an arrow EE direction in FIG. 7, so that the developing device 6 can be demounted from the apparatus main assembly 2. In this way, a constitution in which the leakage and scattering of the developer are not readily generated in the demounting process of the developer supply device 7 and the developing device 6.

As described above, in this embodiment, the opening 31 of the developer supply device 7 is blocked by the two shutters 32*a* and 33*a*. Further, with respect to a lever moving direction for opening (exposing) the opening 31, the directions of the levers 32*b* and 33*b* are opposite directions and are mutually spacing direction. For that reason, in the case where the user accesses the developer supply device 7, it is possible to remarkably reduce a degree of a fear that the user accidentally opens the two shutters 32*a* and 33*b* to cause the leakage-out of the developer.

Comparison Example

Figure 14:
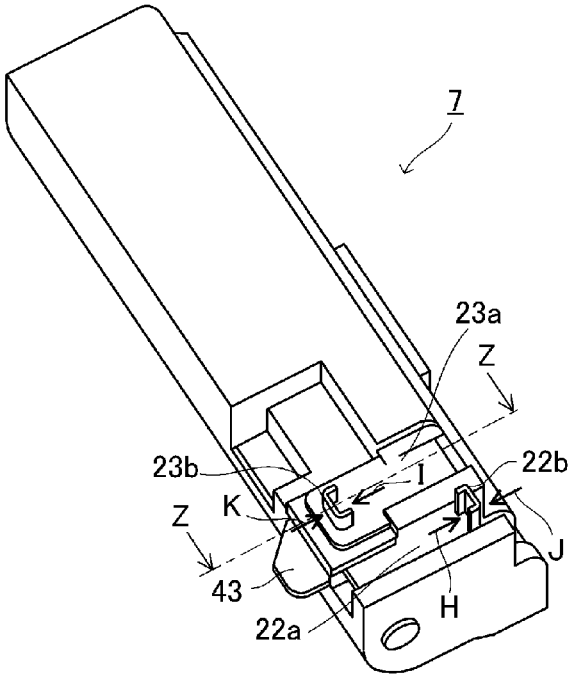
In FIG. 14, (a) and (b) are schematic views each showing a closed state of a shutter of a developer supply device according to Comparison Example.
Figure 14:
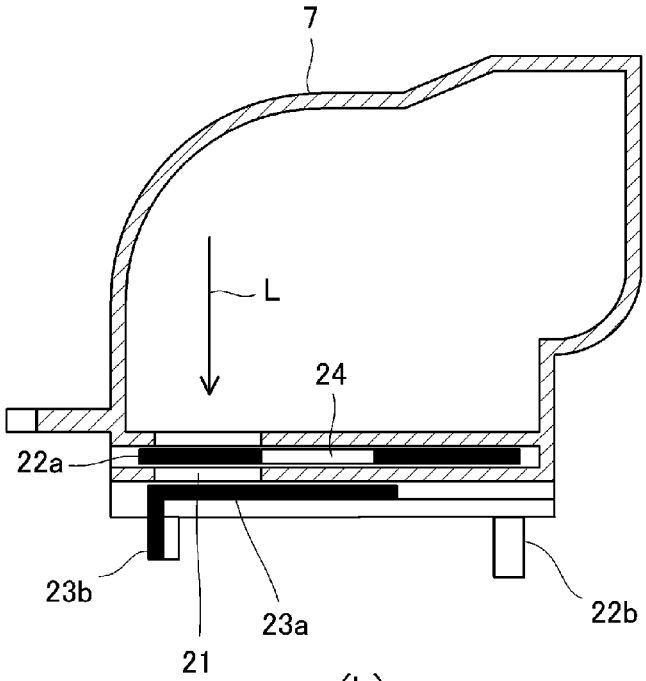
Figure 15:
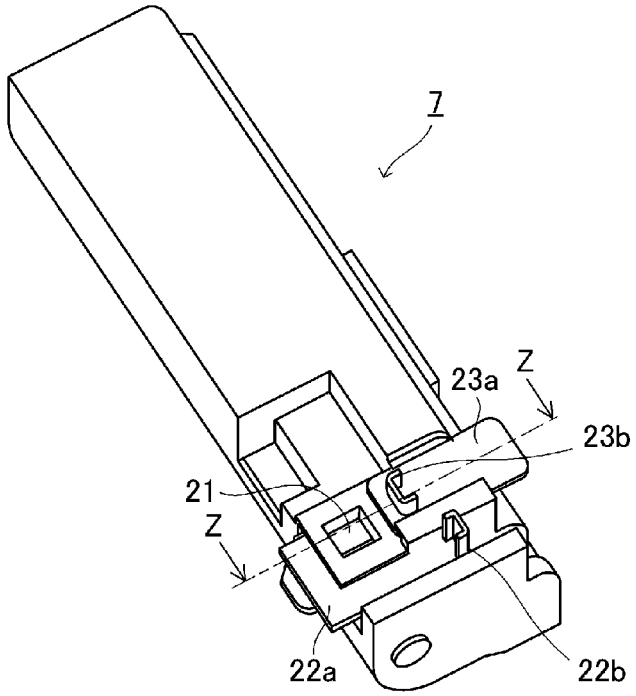
In FIG. 15, (a) and (b) are schematic views each showing an open state of the shutter of the developer supply device according to Comparison Example.
Figure 15:
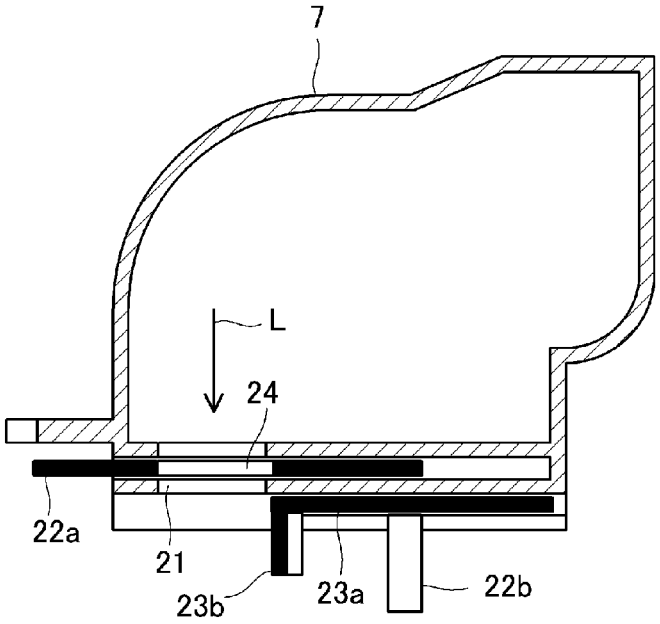

Here, with reference to FIGS. 14 and 15, a shutter structure in Comparison Example will be described. In FIG. 14, (a) and (b) are schematic views each showing a shutter structure of a developer supply device in Comparison Example and showing a closed state of shutters. In FIG. 14, (a) is a schematic perspective view of the developer supply device in Comparison Example as seen from an obliquely lower direction, and (b) is Z-Z cross-sectional view of (a) of FIG. 14. In FIG. 15, (a) and (b) are schematic views each showing a shutter structure of a developer supply device in Comparison Example and showing an open state of shutters. In FIG. 15, (a) is a schematic perspective view of the developer supply device in Comparison Example as seen from an obliquely lower direction, and (b) is Z-Z cross-sectional view of (a) of FIG. 15.

A constitution in Comparison Example is similar to the constitution in Embodiment 1 with respect to use of the double shutter structure and other basic constituent elements, but is different from the constitution in Embodiment 1 in relative positions of two levers for moving the shutters. That is, in the constitution in Embodiment 1, the movement directions of the levers when the levers open the opening 31 where the opposite directions and the mutually spacing directions. On the other hand, in Comparison Example, the movement directions of the levers when the levers open an opening 21 are the opposite directions but are mutually approaching directions.

As shown in (a) and (b) of FIG. 14, a shutter 23*a* is urged by an unshown spring in an arrow I direction and is held at a position where the shutter 23*a* blocks the opening 21. Further, when an urging force directed in an arrow K direction is applied to a lever 23*b*, the shutter 23*a* is moved, against the urging force, to a position where the shutter 23*a* opens (exposes) the opening 21. On the other hand, a shutter 22*a* is urged by an unshown spring in an arrow H direction and is held at a position where the shutter 23*a* blocks the opening 21. Further, when an urging force directed in an arrow J direction is applied to a lever 22*b*, the shutter 22*a* is moved, against the urging force, to a position where a hole 24 of the shutter 22*a* overlaps with the opening 21.

In this way, by the movement of the shutters 22*a* and 22*b*, the opening 21 of the developer supply device 7 is placed in an open state as shown in (a) and (b) of FIG. 15.

Here, in general, a widthwise (short) length of the developer supply device 7 is from about several cm to about several tens of cm, and a size of each of the shutters is about several cm and is such that the user can grip the shutter. For that reason, in the case where the user accesses the developer supply device 7, it is possible to perform an operation in which the two levers 22*b* and 23*b* are held or gripped at the same time. Further, in the constitution in Comparison Example, there is the case where the force directed in the arrow K direction toward the lever 23*b* and the force directed in the arrow J direction toward the lever 22*b* are simultaneously applied by gripping the levers by the user. In that case, both the shutters 22*a* and 23*a* are moved in an opening operation direction, and therefore the opening 21 is open. In this way, in the constitution in Comparison Example, compared with the constitution in Embodiment 1, the shutters are easily opened, so that the developer is easily leaked out and scattered from the developer supply device 7.

Next, with reference to FIGS. 10 and 11, a shutter structure of the developer supply device according to Embodiment 2 will be described. In FIG. 19, (a) and (b) are schematic views each showing the shutter structure of the developer supply device in this embodiment and showing a closed state of shutters, in which (a) is a schematic perspective view of the developer supply device as seen from an obliquely lower direction, and (b) is Z-Z cross-sectional view of (a) of FIG. 10. In FIG. 11, (a) and (b) are schematic views each showing the shutter structure of the developer supply device in this embodiment and showing an open state of the shutters, in which (a) is a schematic perspective view of the developer supply device as seen from the obliquely lower direction, and (b) is Z-Z cross-sectional view of (a) of FIG. 11.

In Embodiment 1, the shutters and the levers are constituted so as to be linearly moved when they are moved to be opened. On the other hand, in Embodiment 2, the shutters and the levers are constituted so as to be rotationally moved when they are moved to be opened.

The developer supply device 7 in this embodiment is provided with first and second shutters 82*a* and 83*a* each capable of opening (exposing) an opening 81. The first shutter 82*a* is provided integrally with a first lever 82*b*, and the second shutter 83*a* is provided integrally with a second lever 83*b*. Further, the shutter 82*a* and the lever 82*b* are rotatable about a rotation-supporting point 86, and is urged in a direction (arrow T direction) in which the shutter 82*a* blocks the opening 81 by a spring 88. The shutter 83*a* and the lever 83*b* are rotatable about a rotation-supporting point 87, and is urged in a direction (arrow U direction) in which the shutter 83*a* blocks the opening 81 by a spring 89.

Figure 10:
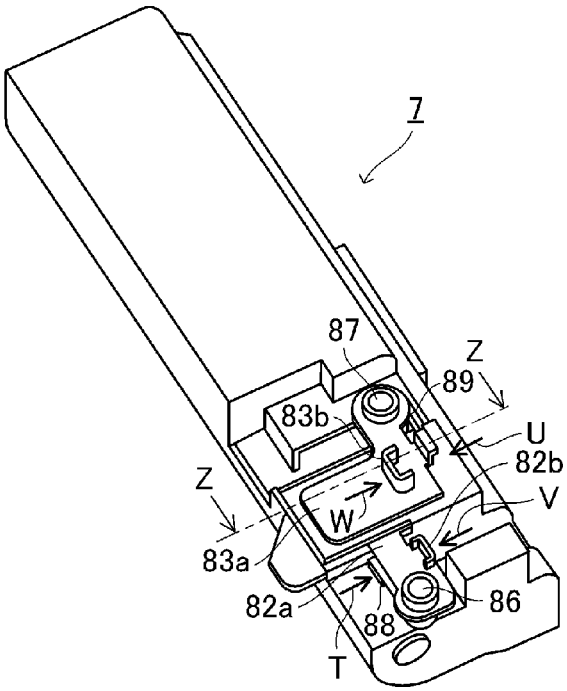
In FIG. 10, (a) and (b) are schematic views each showing a closed state of a shutter of a developer supply device according to Embodiment 2.
Figure 10:
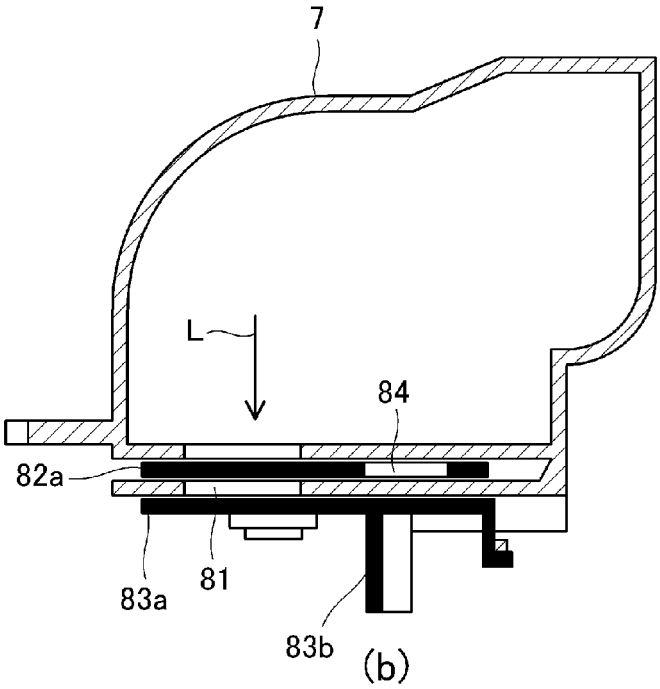
Figure 11:
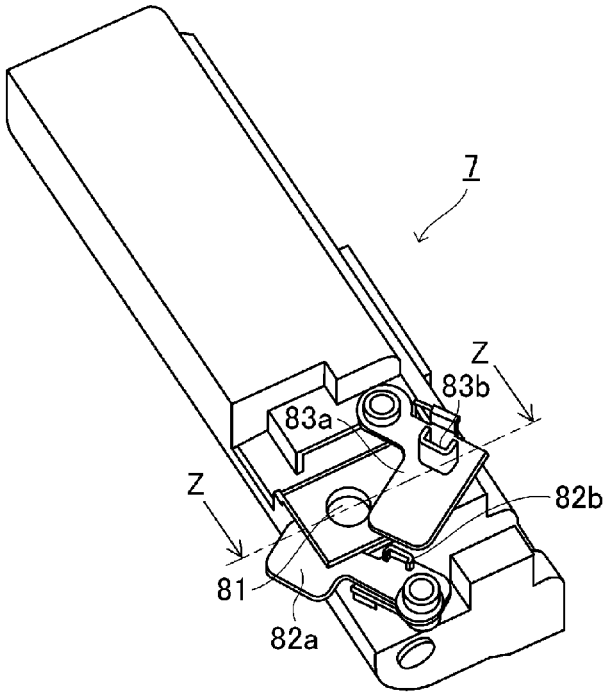
In FIG. 11, (a) and (b) are schematic views each showing an open state of the shutter of the developer supply device according to Embodiment 2.
Figure 11:
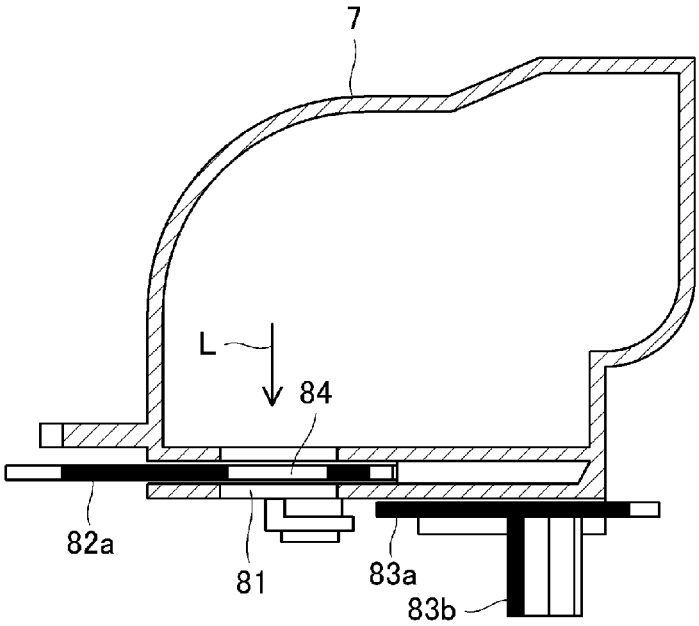
Figure 12:
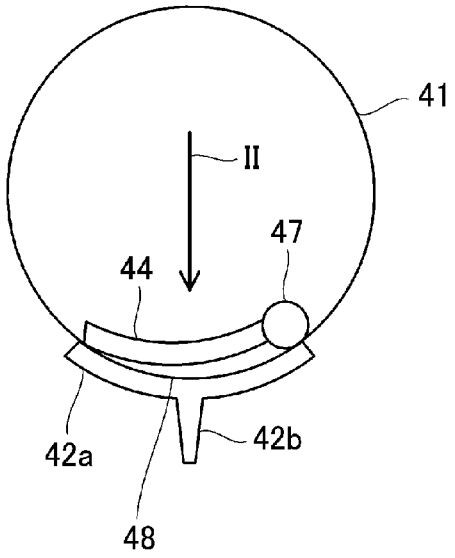
Fig. 12 PRIOR ART
FIG. 12 is a schematic view showing a closed state of a shutter in a conventional shutter structure.
Figure 13:
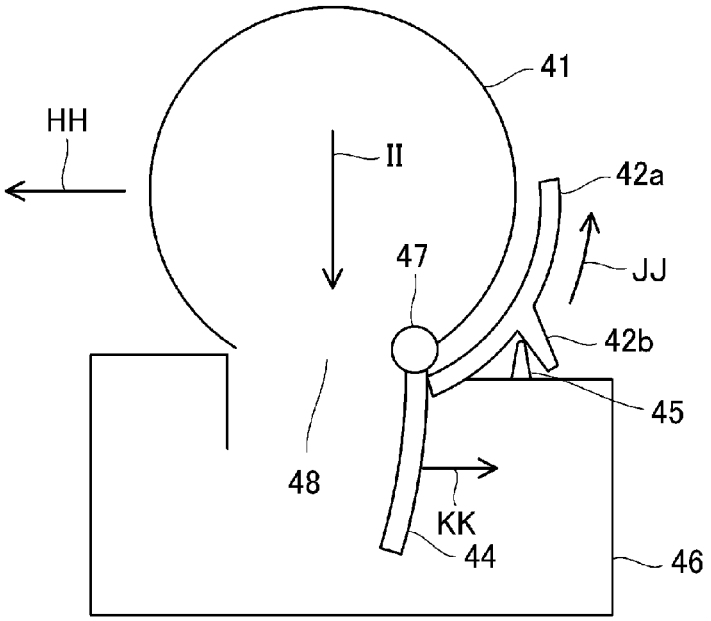
Fig. 13 PRIOR ART
FIG. 13 is a schematic view showing an open state of the shutter in the conventional shutter structure.

In FIG. 10, the opening 81 is blocked by the shutters 82*a* and 83*a*, so that the developer is placed in a state in which the developer is not fed to the outside of the developer supply device 7 along an arrow L direction. Here, when the levers 82*b* and 83*b* are operated in arrow V and W directions, respectively, the shutters 82*a* and 83*a* are rotationally moved to open the opening 81 for the developer as shown in (a) of FIG. 11, so that the developer is feedable through the opening 81. A hole 84 of the shutter 82*a* overlaps with the opening 81, and the shutter 83*a* is deviated from the opening 81, so that the developer is placed in a feedable state to the outside of the developer supply device 7 through the opening 81 along the arrow L direction.

In the constitution in this embodiment, the levers 82*b* and 83*b* are moved in opposite directions and mutually spacing directions (arrow V and W directions), so that the shutters 82*a* and 83*a* are placed in an open state in which the opening 81 is exposed. Accordingly, similarly as in Embodiment 1, in the case where the user accesses the developer supply device 7, it is possible to remarkably reduce the degree of the fear that the user accidentally opens the two shutters 82*a* and 83*a* to cause the leakage-out of the developer. Incidentally, in Embodiment 2, the opening and closing operation of the shutters with the mounting operation of the developing device 6 and the developer supply device 7 is the same as that in Embodiment 1, and therefore will be omitted from description.

Incidentally, in the above-described embodiments, the shutter structure as the characteristic feature is used for the shutter for opening and closing the opening 31 of the developer supply device, but may also be used for the shutter for opening and closing the opening 51 of the developing device 6.

Incidentally, in the above-described embodiments, the constitution in which the levers 32*b* and 33*b* are moved in the opposite directions and the mutually spacing directions to open (expose) the opening 31 is employed, but the present invention is not limited thereto so long as the constitution is such that the two shutters are not readily opened simultaneously when the user accesses the cartridge. For example, a constitution in which the opening 31 is opened by moving the levers 32*b* and 33*b* in the opposite directions and mutually approaching directions and then by moving the levers 32*b* and 33*b* in the mutually spacing directions may also be employed.

According to the present invention, it is possible to provide the developer container having the shutter structure capable of suppressing the leakage-out of the developer.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 110872/2013 filed May 27, 2013, which is hereby incorporated by reference.

What is claimed is:

1. A developer container comprising:

an accommodating frame, provided with an opening through which a developer is passable, for accommodating the developer;

a first shutter and a second shutter which are movable between an open position where the opening is opened and a closed position where the opening is closed;

a first lever, provided on said first shutter, for moving said first shutter by being urged and moved; and a second lever, provided on said second shutter, for moving said second shutter by being urged and moved, wherein each of said first shutter and said second shutter is moved from the closed position to the open position by moving said first shutter and said second shutter in a mutually spacing direction to open the opening.

2. A developer container according to claim 1, wherein said first shutter is linearly moved by urging said first lever.

3. A developer container according to claim 1, wherein said first shutter is rotationally moved by urging said first lever.

4. A developing device detachably mountable to a main assembly of an image forming apparatus, said developing device comprising:

a developer container according to claim 1 from which developer is supplied, wherein, in a process of mounting said developing device into the main assembly of the image forming apparatus, said first shutter of said developer container is moved from the closed position to the open position by urging said first lever by an urging portion provided on said developer container.

5. A process cartridge, detachably mountable to a main assembly of an image forming apparatus, including a process means for performing an image forming process, said process cartridge comprising:

a first bearing member for bearing a latent image; and a developing device according to claim 4.

6. A developer supply device, detachably mountable to a main assembly of an image forming apparatus, for supplying a developer to a developing device, comprising:

a developer container according to claim 1 for accommodating the developer, wherein in a process of mounting said developer supply device into the main assembly of the image forming apparatus, said first shutter is moved from the closed position to the open position by urging said first lever by an urging portion provided on the developing device.

7. An image forming apparatus for forming an image on a recording material with a developer, said image forming apparatus comprising:

an image bearing member for bearing a latent image;

a developer container according to claim 1; and an openable door including an urging portion for urging said second shutter from the closed position to the open position by urging said second lever with a closing operation thereof.

8. A developer container comprising:

an accommodating frame, provided with an opening through which a developer is passable, for accommodating the developer;

a first shutter and a second shutter which are movable between an open position where the opening is open and a closed position where the opening is closed;

a first lever, provided on said first shutter, for moving said first shutter by being urged and moved; and a second lever, provided on said second shutter, for moving said second shutter by being urged and moved, wherein each of said first shutter and said second shutter is moved from the closed position to the open position by moving said first shutter and said second shutter in a mutually approaching direction and then in a mutually spacing direction to open the opening.

9. A developer container according to claim 8, wherein said first shutter is linearly moved by urging said first lever.

10. A developer container according to claim 8, wherein said first shutter is rotationally moved by urging said first lever.

11. A developing device detachably mountable to a main assembly of an image forming apparatus, said developing device comprising:

a developer container according to claim 8 from which developer is supplied, wherein, in a process of mounting said developing device into the main assembly of the image forming apparatus, said first shutter of said developer container is moved from the closed position to the open position by urging said first lever by an urging portion provided on said developer container.

12. A process cartridge, detachably mountable to a main assembly of an image forming apparatus, including a process means for performing an image forming process, said process cartridge comprising:

a first bearing member for bearing a latent image; and a developing device according to claim 11.

13. A developer supply device, detachably mountable to a main assembly of an image forming apparatus, for supplying a developer to a developing device, comprising:

a developer container according to claim 8 for accommodating the developer, wherein in a process of mounting said developer supply device into the main assembly of the image forming apparatus, said first shutter is moved from the closed position to the open position by urging said first lever by an urging portion provided on the developing device.

14. An image forming apparatus for forming an image on a recording material with a developer, said image forming apparatus comprising:

an image bearing member for bearing a latent image;

a developer container according to claim 8; and an openable door including an urging portion for urging said second shutter from the closed position to the open position by urging said second lever with a closing operation thereof.

* * * * *